US008455780B2

(12) United States Patent
Gentsch

(10) Patent No.: US 8,455,780 B2
(45) Date of Patent: Jun. 4, 2013

(54) LOW-VOLTAGE, MEDIUM-VOLTAGE OR HIGH-VOLTAGE ASSEMBLY

(75) Inventor: Dietmar Gentsch, Ratingen (DE)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 13/036,615

(22) Filed: Feb. 28, 2011

(65) Prior Publication Data

US 2011/0163070 A1 Jul. 7, 2011

Related U.S. Application Data

(63) Continuation of application No. PCT/EP2009/006205, filed on Aug. 27, 2009.

(30) Foreign Application Priority Data

Sep. 1, 2008 (EP) ..... 08015423

(51) Int. Cl.
*H01H 33/66* (2006.01)

(52) U.S. Cl.
USPC ..... 218/123

(58) Field of Classification Search
USPC ..... 218/123
See application file for complete search history.

(56) References Cited

U.S. PATENT DOCUMENTS

| | | | | | |
|---|---|---|---|---|---|
| 3,163,734 | A * | 12/1964 | Lee | 218/136 |
| 3,185,798 | A * | 5/1965 | Titus | 218/126 |
| 3,548,135 | A * | 12/1970 | Wood | 218/123 |
| 4,234,771 | A * | 11/1980 | Ohkawa et al. | 218/139 |
| 4,249,050 | A * | 2/1981 | Okumura | 218/147 |
| 4,757,166 | A * | 7/1988 | Slade | 218/134 |
| 6,864,456 | B1 * | 3/2005 | Banghard et al. | 218/123 |
| 6,897,396 | B2 * | 5/2005 | Ito et al. | 218/120 |
| 7,497,122 | B2 * | 3/2009 | Montesclaros et al. | 73/700 |
| 7,563,161 | B2 * | 7/2009 | Perret | 463/13 |
| 2003/0231438 | A1 | 12/2003 | Slade et al. | |

FOREIGN PATENT DOCUMENTS

| | | |
|---|---|---|
| DE | 102 54 497 B3 | 6/2004 |
| EP | 1 535 295 B1 | 3/2006 |

OTHER PUBLICATIONS

International Search Report (PCT/ISA/210) issued on Nov. 25, 2009, by European Patent Office as the International Searching Authority for International Application No. PCT/EP2009/006205.

* cited by examiner

*Primary Examiner* — Truc Nguyen
(74) *Attorney, Agent, or Firm* — Buchanan Ingersoll & Rooney PC

(57) ABSTRACT

The disclosure relates to a voltage assembly having at least one short circuiting device in which a moving contact piece can be closed onto a fixed contact piece. In order to prevent breakdown at least two separated vacuum zones are arranged along a moving path of the fixed contact piece.

17 Claims, 5 Drawing Sheets

LOW-VOLTAGE, MEDIUM-VOLTAGE OR HIGH-VOLTAGE ASSEMBLY

RELATED APPLICATION

This application claims priority as a continuation application under 35 U.S.C. §120 to PCT/EP2009/006205, which was filed as an International Application on Aug. 27, 2009 designating the U.S., and which claims priority to European Application 08015423.0 filed in Europe on Sep. 1, 2008. The entire contents of these applications are hereby incorporated by reference in their entireties.

FIELD

The disclosure relates to a voltage assembly, such as an assembly of low-voltage, medium-voltage, or high-voltage use having at least one short circuiting device in which a moving contact piece can be closed onto a fixed contact piece.

BACKGROUND INFORMATION

Voltage assemblies can be used in arc protecting system such as an arc interrupter, as disclosed in EP 1535295 B1. The arc interrupter described in EP 1535295 provides a vacuum arc interrupter having a vacuum chamber assembly and an adjacent pressure chamber assembly. A first conductor is within a vacuum chamber in the vacuum chamber assembly and a second conductor, which is a part of the pressure chamber assembly and disposed outside of the vacuum chamber. The two conductors are electrically coupled by a bullet assembly. The bullet assembly includes a conductive lance. The bullet assembly is slidably disposed within a pressure chamber in the pressure chamber assembly. The lance has an inner part under vacuum atmosphere and an outer part used to gain connection inside the pressure area. When the pressure in the pressure chamber is rapidly increased by a gas generation device (e.g. micro gas generator), the bullet assembly moves to a second position where the lance contacts the second conductor and extends beyond the pressure chamber assembly to contact the first conductor. To access the first conductor, the lance punctures a seal that is integrated into the vacuum chamber assembly, here the lid of the vacuum device.

This arc protecting system includes only one vacuum chamber and one pressure chamber. In the pressure chamber, the gas generation is generated by gas ignition, which moves a piston or other mechanism as desired. Disadvantages of this construction include the high pressure chamber and the vacuum chamber being in a direct relationship and separated only by a membrane. As a result, during active movement of the movable contact piece the vacuum will be destroyed along the course of movement. To obtain a robust dielectric behaviour of the device a membrane can be used to enhance the dielectric stiffness by establishing at least two separate vacuum zones. This modification establishes a double (or multigap) gap system with the well known behaviour.

SUMMARY

An exemplary embodiment of the present disclosure is directed to a voltage assembly. The voltage assembly includes a moving contact piece, a fixed contact piece, at least one short-circuiting device in which the moving contact piece can be closed onto the fixed contact piece, and at least two vacuum zones arranged along a moving path of the moving contact piece.

Another exemplary embodiment of the present disclosure is directed to a switch gear that includes a voltage assembly. The voltage assembly including a fixed contact piece, at least one short-circuiting device in which the moving contact piece can be closed onto the fixed contact piece, and at least two vacuum zones arranged along a moving path of the moving contact piece.

Further, an exemplary embodiment is directed to an electric interconnecting system that includes a voltage assembly. The voltage assembly having a fixed contact piece, at least one short-circuiting device in which the moving contact piece can be closed onto the fixed contact piece, and at least two vacuum zones arranged along a moving path of the moving contact piece.

The voltage assembly includes a fixed contact piece, at least one short-circuiting device in which the moving contact piece can be closed onto the fixed contact piece, and at least two vacuum zones arranged along a moving path of the moving contact piece

DETAILED DESCRIPTION

Figure 1:
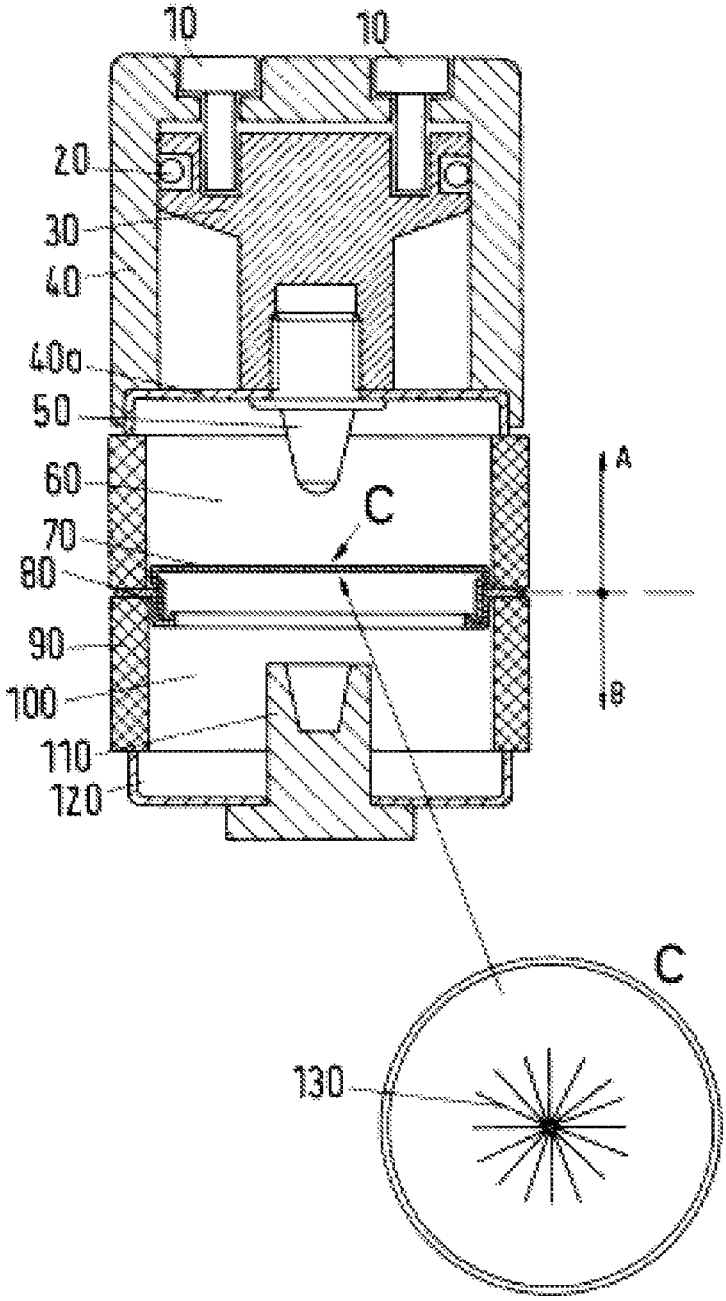
FIG. 1 illustrates an embodiment of the disclosure.

An object of the exemplary embodiments described in the present disclosure is to prevent an occurrence of a breakdown, which prevents arc ignitions during service.

Exemplary embodiments of the present disclosure along the moving path of the moving contact piece are arranged to include at least two separated vacuum zones or vacuum volumes arranged along a moving path of a moving contact piece. By this feature, at least two vacuum zones or vacuum volumes are arranged along the moving path to establish redundancy and to prevent a breakdown during the service life under any rated voltage usage condition. Through a serial arrangement of at least two separated vacuum zones, the vacuum remains functional even when the gas generator is ignited.

In a further embodiment, the vacuum zones can be separated by a separating element through which the moving contact piece can be moved during the short circuiting event.

The separating element can be a membrane made of metal, glass, ceramic, plastic, or any other suitable material as desired. This membrane is physically closed and has no openings except a predetermined weak breaking line or point, which is a part of a further exemplary embodiment. The membrane physically separates each vacuum zone from each other, so that a vacuum redundancy along the moving path of the moving contact is established. No breakdown will occur under rated voltage conditions during the service life of the device.

In another exemplary embodiment, the vacuum zones are arranged serially along the moving path, in order to realize a high withstand voltage. The vacuum zones arranged in parallel along the moving path in order to realize a high ampacity.

Another exemplary embodiment includes arranging two parallel contact pairs within one vacuum chamber assembly or arranging two parallel vacuum chamber assemblies with two parallel contact pairs inside of each vacuum chamber assembly. In both embodiments a high ampacity of the complete assembly can be realized for high current uses.

An exemplary embodiment includes dividing the moving path into three zones which are arranged serially. The first upper zone can be a piston with a rod, which together invoke the movement of the moving contact. The piston has a surrounding seal, which can be of a coiled metal foil, or other suitable material as desired, that realizes a contact between an upper metallic chamber wall part. The upper metallic chamber wall part being electrically connected to an external contact. The piston can be moved by the generation of a propellant charge on the piston side, which generates a high gas pressure to move the contact piece. The upper side of the cylinder in which the piston-contact piece arrangement is moved, is not under pressure because it is sealed with a surrounding seal of the piston against the upper cylinder which is under pressure after ignition of the gas propellant device.

When under pressure, the rod moves in a downward direction and cuts through a predetermined weak breaking line in the first vacuum zone and afterwards the second vacuum zone, which is substantially close to a counter-part contact piece i.e. the non-moving contact piece.

Along each position of the moving path, vacuum can be sustained in the region of the moving contact pieces.

The use of such an assembly is advantageous in a device such as a switch gear. A further advantageous use is in an electric interconnecting system, such as a short circuiting device in an interconnector, a cable interconnector, an interconnecting system or other suitable system desired. These advantages can be realized as a result of the compact construction of the exemplary embodiments as provided in the present disclosure.

A further exemplary embodiment includes the contact parts, such as a plug and a bushing being arranged under the vacuum atmosphere within the device.

Figure 3:
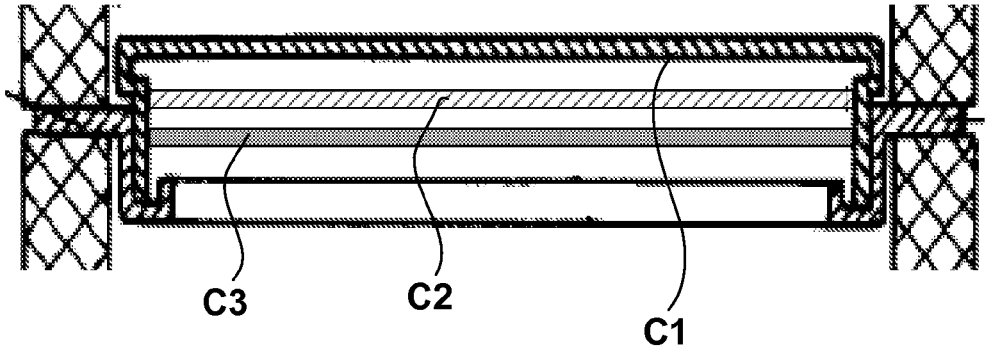
FIG. 3 illustrates another embodiment of the disclosure in which the separating element includes at least three membranes.

Furthermore by using more than two membranes, the material of each membrane can be different. See, for example, FIG. 3, which illustrates three membranes C1-C3 each being made of a different material.

In another exemplary embodiment of the present disclosure, one or more vacuum zones can be connected by having a bore within the membrane plate. When a perforated separation membrane is also included in this configuration realization of the aforementioned advantages is realized.

Figure 4:
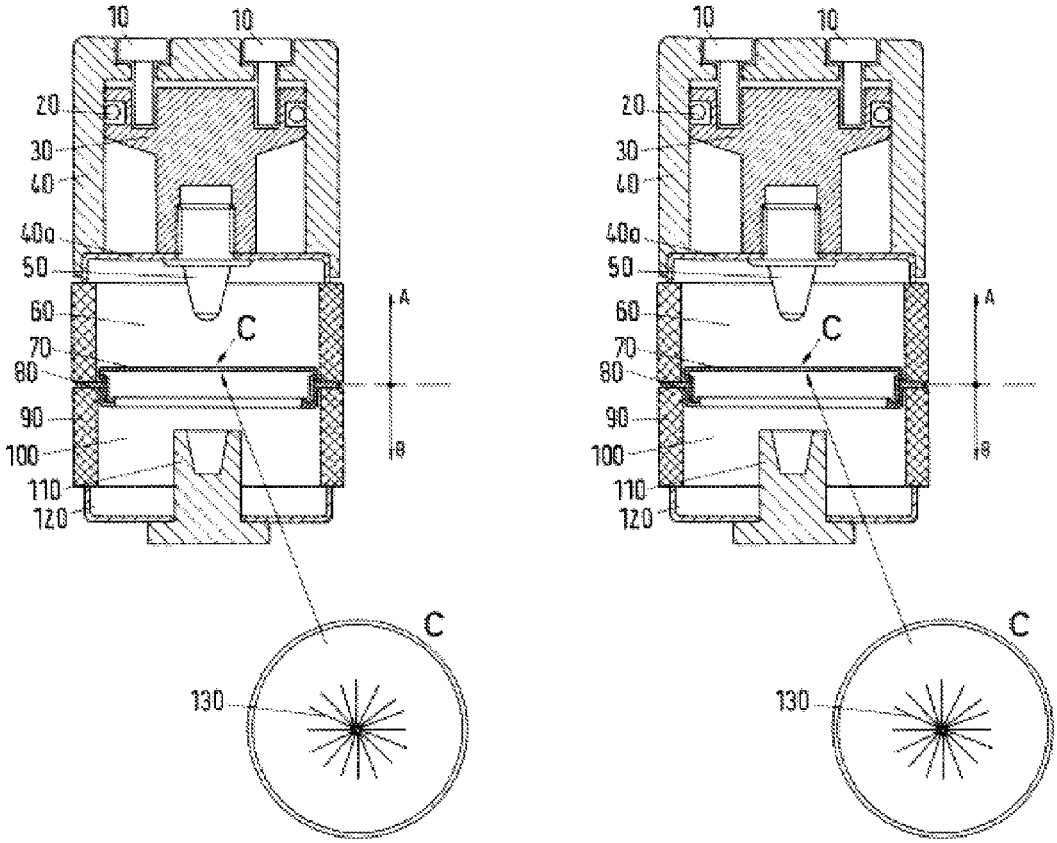
FIG. 4 illustrates another embodiment in which the assembly includes at least two short-circuitry devices that are arranged in parallel.

Furthermore, other exemplary embodiments can be advantageous by including two or more devices in parallel to cover high short-circuit current demands, as illustrated in FIG. 4.

Figure 5:
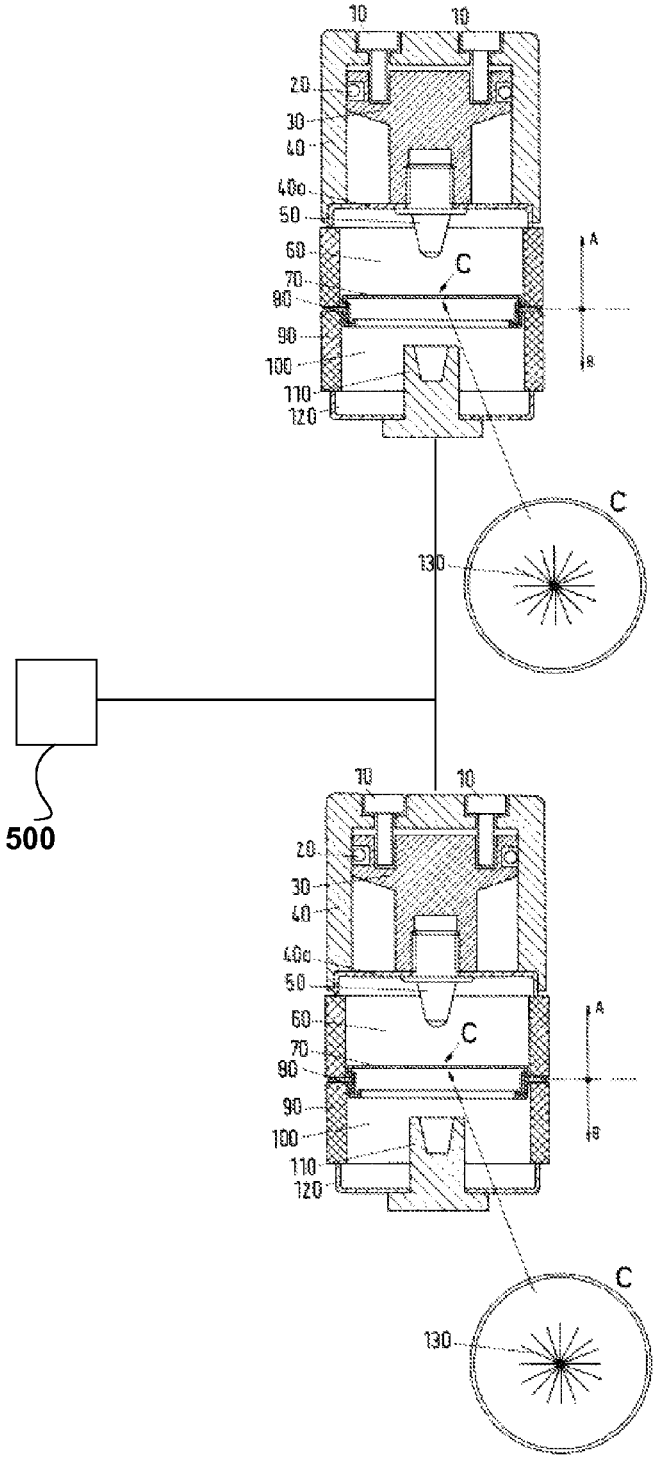
FIG. 5 illustrates another embodiment in which the assembly includes two or more devices arranged in series.

In another exemplary embodiment, the assembly has two or more complete devices which can be arranged in series to cover high voltage demands with the same device, as illustrated in FIG. 5.

In a configuration of two or more complete devices arranged in series and the first device being at earth potential, these devices can be ignited by a current impulse and a following device can be ignited along the moving path via a mechanical ignition of the second microgas generator 500, as illustrated in FIG. 5.

The voltage assembly as described in the present disclosure can be advantageously used in a transformer as a short circuiting device.

Figure 2:
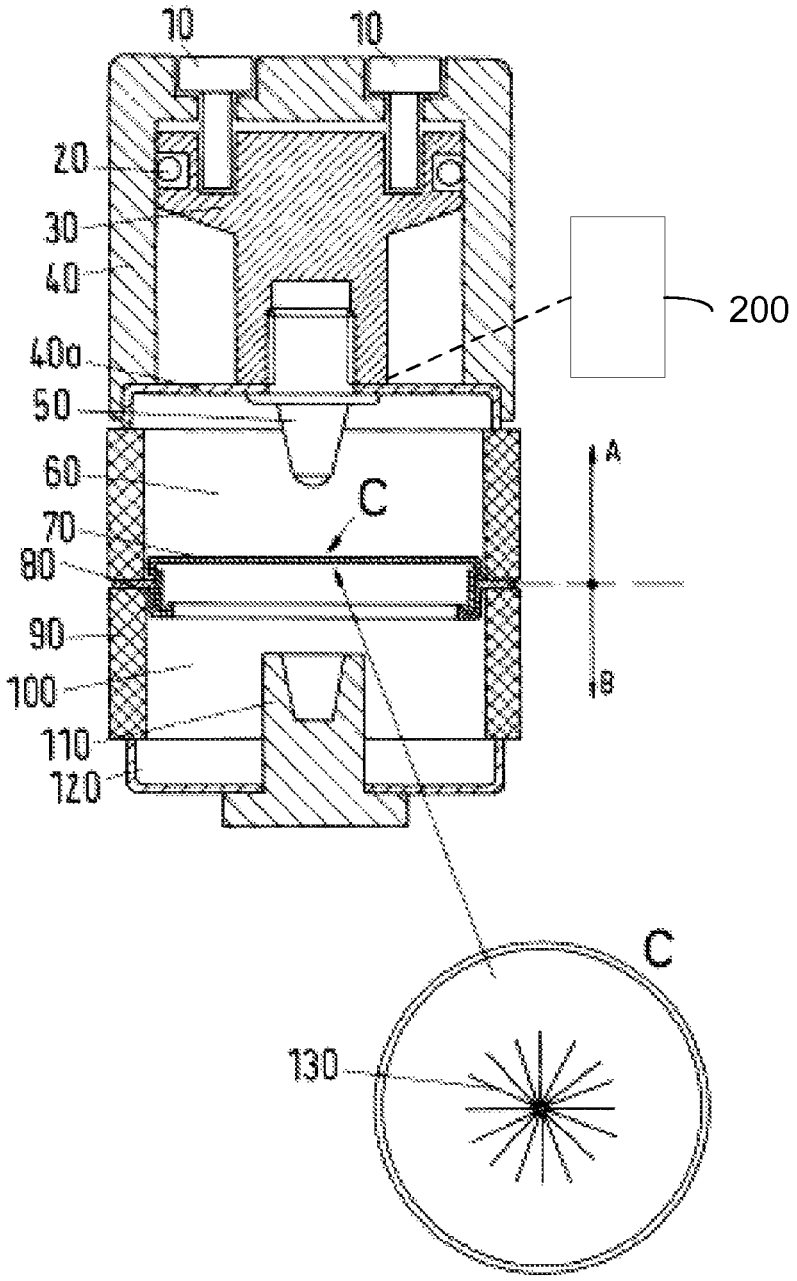
FIG. 2 illustrates an embodiment of the disclosure.

FIG. 1 shows a longitudinal section of a vacuum-chamber in accordance with an exemplary embodiment. Inside a metallic cylinder 40 is arranged a piston 30 with a folded metallic foil 20 which effects an electric contact between the movable piston 30 and the cylinder 40, as well as a seal between the piston and the inner cylinder wall. The cylinder region 40 upon the piston will be impinged by the propellant charge generator 10 (FIG. 2 illustrates the location of the propellant charge 200 behind the piston 30). The foil 20 will have a double function. The first function is to seal the pressure chamber part of the cylinder 40 upon the piston 30 against first vacuum zone 60 when the piston 30 will be moved.

The piston is directly connected with a conical movable contact piece 50. When the propellant charge is ignited, the piston can move through a first lid 40*a*, in which is a first predetermined weak breaking line is implemented. Upon further movement, the conical movable contact piece 50 can cut through a membrane 70 which includes a predetermined weak breaking area which is arranged in the center of the membrane 70.

The membrane 70 separates the first vacuum zone 60 and a second vacuum zone 100. Upon further movement, the conical contact piece will enter into a complementary shaped conical opening in a non-moving portion of the contact piece and does establish a closed short circuiting contact. The non-moving portion of the contact piece is connected externally with an electrical connection. The moving contact 50 has a counterpart electrical connection over the coiled seal-like metallic foil 20 in the metallic piston 30, and over the metallic foil 20 to the metallic cylinder 40 which is externally connected with the other electrical contact.

So in each position along the moving path of the moving contact piece 50 a separation between the "pressure chamber" in which the ignition of the gas charge will take place, and the first vacuum chamber 60 is realized, and during further movement separation between the pressure chamber and second (or more than two) vacuum chamber is also realized.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A voltage assembly comprising:

a moving contact piece;

a fixed contact piece;

at least one short-circuiting device in which the moving contact piece can be closed onto the fixed contact piece; and at least two vacuum zones arranged in a moving path of the moving contact piece, wherein the two vacuum zones are separated by a separating element through which the moving contact piece is moved.

2. The voltage assembly according to claim 1, wherein the separating element is a membrane.

3. The voltage assembly according to claim 2, wherein the membrane is made of metal, glass, ceramic or plastic.

4. The voltage assembly according to claim 1, wherein the separating includes at least one membrane each membrane including a predetermined weak breaking line or zone.

5. The voltage assembly according to claim 1, wherein the at least two vacuum zones are arranged serially along the moving path which establishes a high withstand voltage in the assembly.

6. The voltage assembly according to claim 1, wherein the at least two vacuum zones are arranged in parallel along the moving path of the moving contact piece, which establishes a high ampacity in the assembly.

7. The voltage assembly according to claim 1, wherein three vacuum zones are arranged serially along the moving path of the moving contact piece.

8. The voltage assembly according to claim 1, wherein the moving contact is moved by a propellant charge or gas generator.

9. A switchgear comprising a voltage assembly as claimed in claim 1.

10. An electric interconnecting system comprising a voltage assembly as claimed in claim 1.

11. A transformer comprising a short circuit device that includes the voltage assembly as claimed in claim 1.

12. The voltage assembly of claim 1 further comprising:

contact parts are arranged under a vacuum atmosphere within the device, wherein the contact parts include at least one of a plug and bushing.

13. The voltage assembly according to claim 2, wherein the separating element includes at least three membranes, and wherein each membrane is made of a different material.

14. The voltage assembly according to claim 2, wherein one or more vacuum zones can be connected through a bore within a plate of the membrane.

15. The voltage assembly according to claim 1, wherein the assembly includes at least two short-circuitry devices that are arranged in parallel to cover high short-circuit current demands.

16. The voltage assembly as claimed in claim 1, wherein the assembly includes at least two short-circuitry devices that are arranged in series to cover high voltage demands with the same device.

17. The voltage assembly according to claim 1, wherein the assembly comprises two or more complete devices arranged in series, wherein a first device of the two devices is at earth potential and is ignited by a current impulse and a second device of the two devices is ignited along the moving path through a mechanical ignition of a second microgas generator.

* * * * *